US009108453B2

(12) United States Patent
Cenzano et al.

(10) Patent No.: US 9,108,453 B2
(45) Date of Patent: Aug. 18, 2015

(54) SORTABLE NOTEPAD

(71) Applicant: R.R. Donnelley & Sons Company, Chicago, IL (US)

(72) Inventors: Lauren Cenzano, N. Babylon, NY (US); Denise Ceron, Syosset, NY (US); Bryan Helton, McKinney, TX (US); Juliet Kenney, Brooklyn, NY (US); Meryl Altuch, Port Washington, NY (US)

(73) Assignee: R.R. DONNELLEY & SONS COMPANY, Chicago, IL (US)

( * ) Notice: Subject to any disclaimer, the term of this patent is extended or adjusted under 35 U.S.C. 154(b) by 353 days.

(21) Appl. No.: 13/681,989

(22) Filed: Nov. 20, 2012

(65) Prior Publication Data

US 2013/0129403 A1 May 23, 2013

Related U.S. Application Data

(60) Provisional application No. 61/563,519, filed on Nov. 23, 2011.

(51) Int. Cl.

| | |
|---|---|
| ***B42F 13/14*** | (2006.01) |
| ***B42F 13/22*** | (2006.01) |
| ***B42F 13/40*** | (2006.01) |
| ***B42F 13/12*** | (2006.01) |
| ***B42F 13/16*** | (2006.01) |
| ***B42D 5/00*** | (2006.01) |
| ***B42F 3/04*** | (2006.01) |

(52) U.S. Cl.

CPC ..... *B42F 13/22* (2013.01); *B42D 5/008* (2013.01); *B42F 3/04* (2013.01); *B42F 13/12* (2013.01); *B42F 13/165* (2013.01); *B42F 13/40* (2013.01)

(58) Field of Classification Search

CPC ..... B42D 5/008; B42D 5/005; B42F 3/003
USPC ..... 402/49, 52, 54; 281/44; 24/67.1, 67 P, 24/67.3

See application file for complete search history.

(56) References Cited

U.S. PATENT DOCUMENTS

| | | | | |
|---|---|---|---|---|
| 241,716 | A | 5/1881 | Plummer | |
| 724,320 | A | 3/1903 | McGregor | |
| 1,614,838 | A | 1/1927 | Gorin | |
| 1,747,659 | A | 2/1930 | Bottle | |
| 2,051,551 | A | 8/1936 | Evans | |
| 3,116,738 | A | 1/1964 | Wentges | |
| 3,612,709 | A * | 10/1971 | Miyamoto | 402/22 |

(Continued)

FOREIGN PATENT DOCUMENTS

| | | |
|---|---|---|
| CN | 1480103 | 3/2004 |
| CN | 1561925 | 1/2005 |

(Continued)

*Primary Examiner* — Kyle Grabowski
(74) *Attorney, Agent, or Firm* — Hanley, Flight & Zimmerman, LLC

(57) ABSTRACT

An adjustable binding system with a binding portion that can bind together papers, dividers, a backing, and other material. The binding portion can open and close to facilitate organizing, adding, removing, etc. The binding portion can have hinged parts that connect mating pairs of binding elements, such as protrusions inserted into hole-punched paper, and connected to another element to form a binding within the binding portion. The binder can have a minimal profile to provide a customizable binder with the feel of a disposable notepad.

17 Claims, 14 Drawing Sheets

(56) References Cited

U.S. PATENT DOCUMENTS

| | | | | |
|---|---|---|---|---|
| 4,175,777 | A | 11/1979 | Horn | |
| 4,307,972 | A | 12/1981 | Errichiello | |
| 4,637,149 | A | 1/1987 | Rivkin | |
| 4,730,972 | A * | 3/1988 | Sun et al. | 402/52 |
| 4,878,776 | A | 11/1989 | Orlandini | |
| 4,898,115 | A | 2/1990 | Bowlay-Williams | |
| 4,970,984 | A | 11/1990 | Vazquez | |
| 5,248,280 | A | 9/1993 | Lockwood et al. | |
| 5,283,091 | A | 2/1994 | Darvell et al. | |
| 6,213,517 | B1 | 4/2001 | Goluszka et al. | |
| 6,217,443 | B1 | 4/2001 | Green, Jr. | |
| 6,357,797 | B1 | 3/2002 | Lee | |
| 7,360,960 | B2 * | 4/2008 | Hite | 281/30 |
| 7,416,356 | B2 | 8/2008 | Quilantan | |
| 7,708,487 | B2 | 5/2010 | Leibman | |
| 2003/0178837 | A1 | 9/2003 | Ung et al. | |
| 2010/0171299 | A1 * | 7/2010 | Myers | 281/38 |

FOREIGN PATENT DOCUMENTS

| | | | |
|---|---|---|---|
| CN | 1935097 | | 3/2007 |
| DE | 2948473 | * | 6/1981 |
| DE | 3208149 | * | 9/1983 |
| GB | 2044674 | * | 10/1980 |
| GB | 2271963 | * | 5/1994 |
| WO | WO 2007073810 | | 7/2007 |
| WO | WO 2009067497 | | 5/2009 |

* cited by examiner

SORTABLE NOTEPAD

CROSS-REFERENCE TO RELATED APPLICATION

This application claims priority to U.S. Provisional Application No. 61/563,519 filed Nov. 23, 2011. The entire disclosure of the above-referenced application is incorporated herein by reference in its entirety.

TECHNICAL FIELD

The present subject matter relates generally to a notepad in which the pages can be replaced and/or resorted.

BACKGROUND

Known notepads have a permanent binding. For example, a common notepad can include a set of blank or ruled papers (with an optional perforation for easy permanent removal of one or more pages) bound to a backing, which is typically a piece of cardboard of the same size as the papers. Typical bindings include staples through a top portion of each paper and the backing above the perforation line. These can also include a cardboard topper, approximately the same size as the perforated section, stapled on the front side of the stack, along with the backing on the rear side of the stack. The stapled pages, backing, and topper can have a cover affixed around the end (e.g., covering the topper, the top edge of the papers, and a top portion of the backing). Logos are often printed on this cover. The construction of typical notepads is made for production and minimizing bulk, since the notepads are barely thicker than the stack of sheets they contain, and practically no larger in length and width. Notepads tend to be designed for single use. Once the papers are used and optionally removed, they are not replaceable, so the notepad is discarded.

Common reusable binders are also known, such as ring binders, which allow for reuse and reorganization. These binders often have round or D-shaped rings that open to receive hole-punched papers and close to temporarily bind them. Papers can be removed, added, and reorganized, and they can be flipped around the rings to the opposite side of the rings. Further, partitions and/or tabbed dividers can be added and removed. These binders tend to be bulky compared to notepads.

It is desirable to provide an improved binding arrangement that is reusable and organizable, while having a minimal profile, similar to a disposable notepad.

SUMMARY

An adjustable binding system, including punched paper, that can include a plurality of sheets of paper having aligned punched holes. The binding system can include a binding portion having a first portion hingedly connected to a second portion, where the second portion can include protrusions aligned with the punched holes of the punched paper configured to be inserted through the punched holes to retain the punched paper, and where the first portion can include retaining features in alignment with the protrusions to cooperatively and releasably secure the binding portion to the punched paper. A width of the binding can be approximately equal to a width of the punched paper. The height of the binding portion can be greater than but similar to a height of the punched paper. The length of the protrusions can be greater than but similar to the height of the punched paper.

The protrusions can extend through and past the first portion. The protrusions can include teeth and the retaining feature can include a lock element aligned with the teeth and configured to be releasably held by the teeth to releasably secure the binding portion. The protrusions can also include two sets of teeth on two sides of a dividing wall and the retaining feature can include two lock elements on either side of a gap aligned with the two sets of teeth and dividing wall to be releasably held by the teeth to releasably secure the binding portion. The first portion can include a grabbing feature extending away from the punched paper secured by the binding portion. The protrusions can extend through and past the first portion but at a distance past the first portion less than the grabbing feature extends away from the binding portion.

The binding system can also include a backing having a width dimension and length dimension approximately equal to the width and a length of the punched paper. The height of the backing can be less than the height of the punched paper and greater than a height of a sheet of paper within the punched paper. The backing can be substantially more ridged than a sheet of the punched paper. The binding system can also include at least one divider having a width and a length approximately equal to the width and length of the punched paper. the divider(s) can be more ridged than a sheet of the punched paper and less ridged than the backing. A tab feature on an edge can protrude beyond a remaining portion of that edge. The paper and dividers can be removable, reordered, reinserted, etc.

Another adjustable binding system can include a mating pair of first and second binding elements. The binding system can include a binding unit having a second portion connected via a hinge to a first portion. The first binding element can be attached to the first portion, and the second binding element can be attached to the second portion. The first and second portions can be aligned by the hinge such that first and second elements mate to form a binding. Also, the binding unit can include a width along the hinge and a length perpendicular to the hinge, and the width can be at least three times larger than the length.

The binding system can include paper including a plurality of sheets of paper with aligned holes configured to have first or second binding element inserted therethrough. The hole-punched paper can be a width approximately equal to the width of the binding unit, and a length greater than the width of the binding unit. The binding system can include a backing, and can have a width approximately equal to the width of the binding unit and a length approximately equal to the length of the punched paper.

The first portion can cover a portion of a top-most sheet of the paper. This portion can be less than 20% of the top-most sheet. The paper can include a perforation line running a width of the sheet and dividing a part of the sheet that includes the aligned holes and a remaining portion of the sheet. The perforation line can be near the aligned holes and the remaining portion of the sheet can be substantially larger than the part of the sheet that includes the aligned holes.

The binding unit can bind a maximum thickness of bound material when the first and second binding elements are mated. The binding unit can have a height perpendicular to both the width and the length measured from a top of the first portion to a bottom of the first portion. The height can be larger than but approximately equal to the maximum thickness. The height can be less than 10% greater than the maximum thickness of bound material. The first binding element can be affixed to or integrally formed from the first portion. The second binding element can be affixed to or integrally formed from the second portion.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
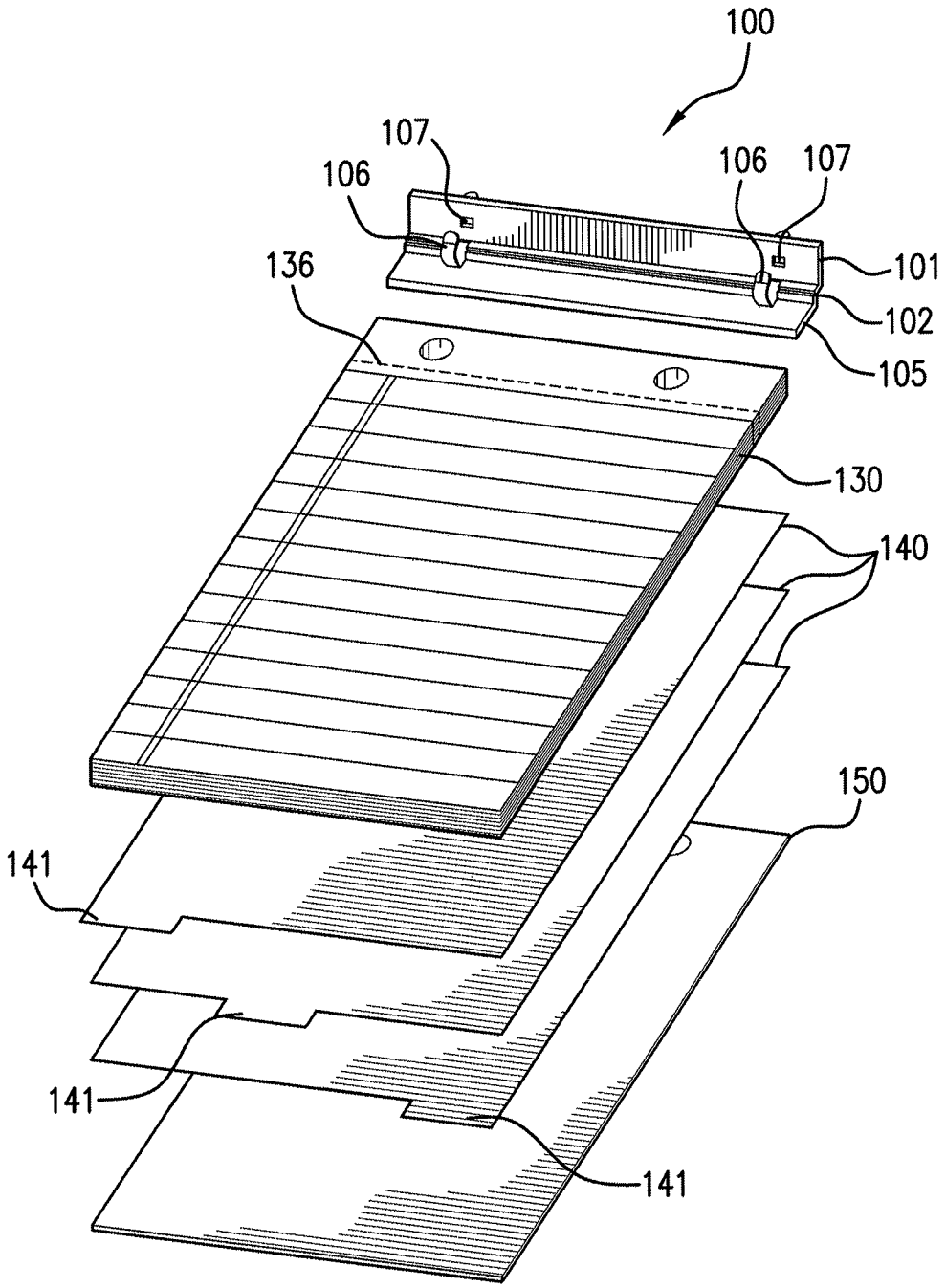
FIG. 1 is an view of an unassembled notepad device constructed according to an exemplary embodiment of the present invention.
Figure 5:
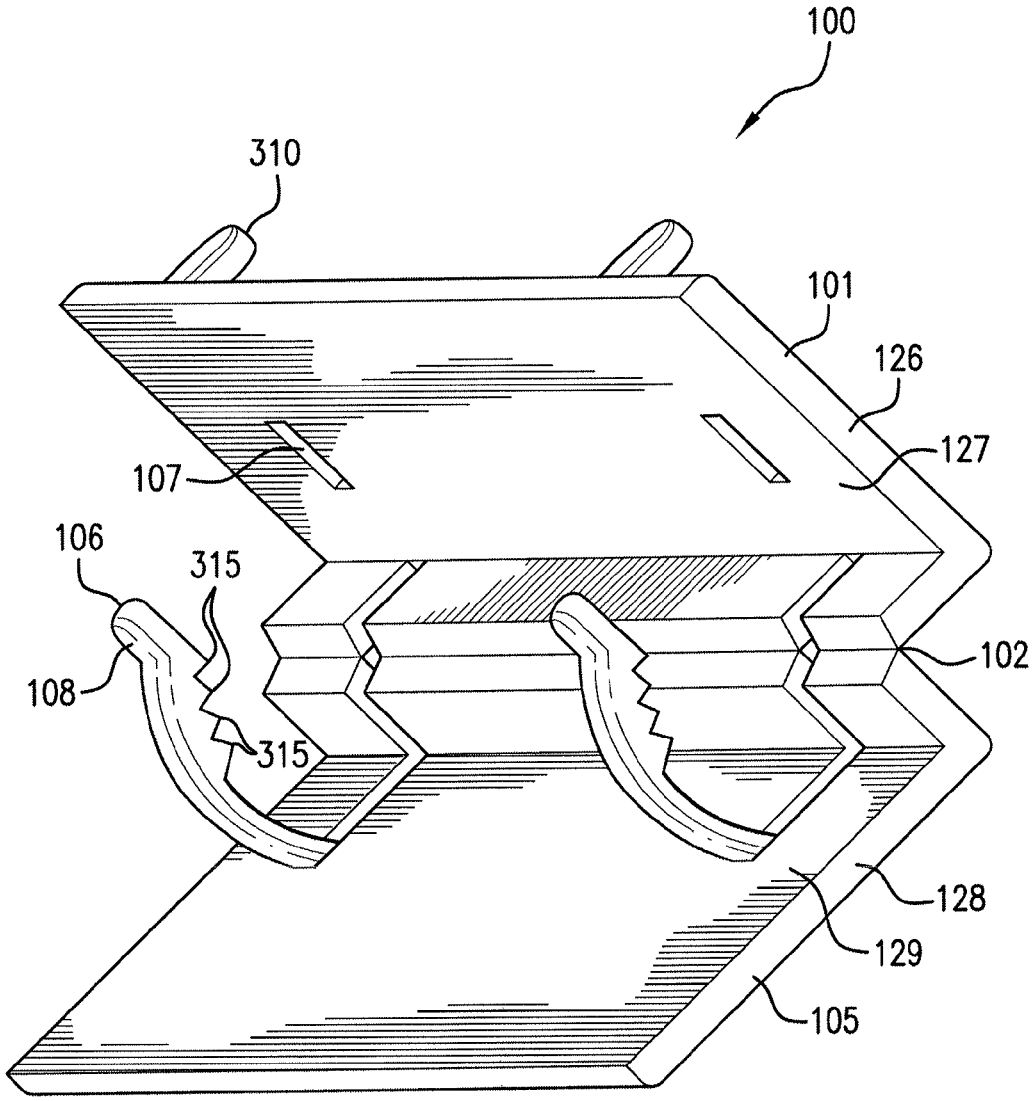

Referring to FIG. 1, an exemplary embodiment can include a removable binding unit 100, a stack of papers 130, dividers 140, and a base portion unit 150 (e.g., a backing panel). Binding unit 100 can include a first binding portion 101 movably, and preferably pivotally, connected to a second binding portion 105, such as by hinge 102. The first and second binding portions 101,105 in this embodiment include upper and lower members 126 and 128, respectively (as referenced in FIGS. 5 and 7), each with inner and outer surfaces 127,129 and 123,125 that are preferably substantially flat to create a low profile when engaged against the upper and lower surfaces of a stack of papers with or without a base member. The inner and outer surfaces 127,129 and 123,125 are preferably parallel in a closed position about a full stack as shown in FIG. 1. The inner surfaces 127,129 preferably are free of protrusions except for protrusions meant to engage paper bound therein, such as through holes of the paper, although alternative embodiments have other configurations. The outer surfaces 123,125 can be completely flat can have protrusions, although any protrusions therefrom are preferably kept to a minimum to provide the feel of a traditional notepad.

The binding portions 101,105 preferably include a binding protrusion, configured for reception through holes in the held stack of paper, and a locking member configured for locking the binding portions in a closed position. In the embodiment of FIG. 1, the binding protrusion and locking member are combined. Specifically, as shown in FIGS. 1-10, the second binding portion 105 of this embodiment has a binding/locking protrusion 106 extending towards an interior of portion 101 in alignment with a second binding feature 107 disposed on the first binding portion 101. Other configurations of the binding unit 100 are also possible. For example, additional exemplary embodiments described below include two hinges, e.g., connecting three straight portions. The binding unit 100 can be configured to align and connect protrusion 106 with feature 107 when bent at hinge 102 (e.g., at an inner angle of 180 degrees or less).

Protrusions 106 can be dimensioned to fit within a standard paper hole-punch (e.g., protrusions 106 can be smaller than about 0.35 inches in diameter (width), e.g., 0.3 inches). A stack of paper 130 (e.g., a plurality of aligned sheets of paper) can include holes aligned with the binding features 106,107. For example, each sheet can have a standard hole-punch of about 0.35 inches in diameter, which can have a center point located some distance (e.g., about 0.375 inches) from the top edge and some distance (e.g., about 1.25 inches) from a side edge. Likewise, dividers 140 can be configured to approximately the same size as sheets 130, or other suitable sizes, including having a protruding tab 141. Dividers 140 can also include aligned holes to fit over binding protrusions 106. Likewise, base portion 150 can be configured to approximately the same size as sheets 130 or any other size (e.g., having the same width as sheets 130 and dividers 140, with having a length similar to an extended length at tab feature 141).

Figure 2:
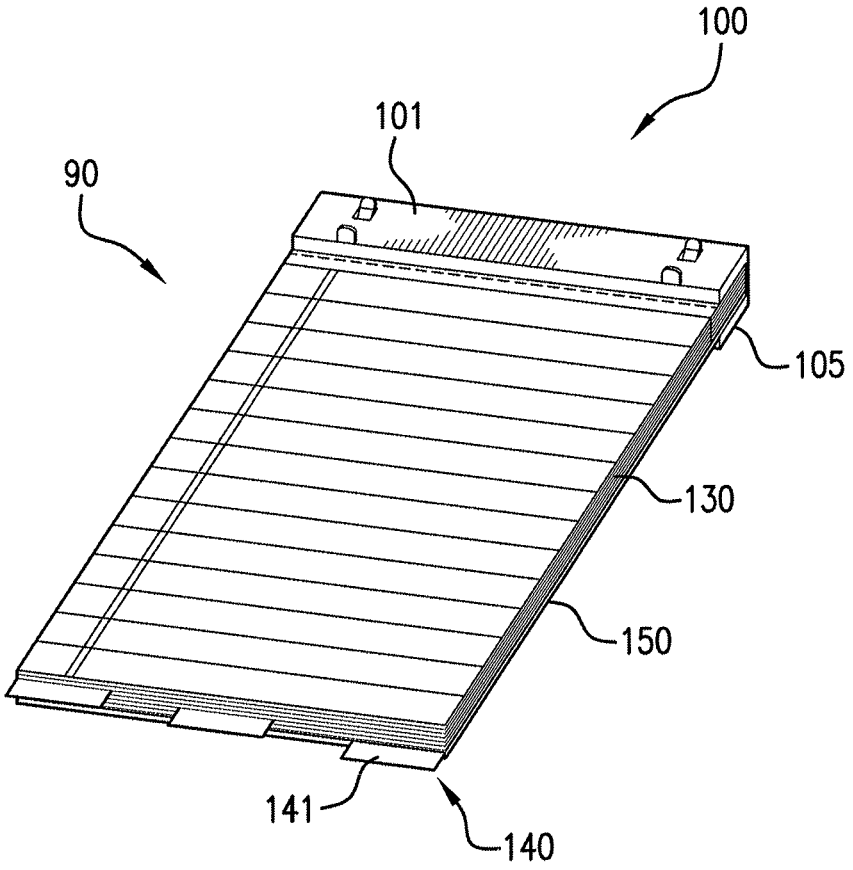
FIG. 2 is a view thereof in an assembled form.

Other exemplary embodiments can include a cover, such as another base portion 150 to be included over sheets 130, or preferably sheets 130 can remain uncovered, similar to a notepad. Sheets 130 can be bound together into a unit, bound into several units, or left as a stack of loose sheets. Each sheet or unit can be rearranged in different orders, with dividers 140 inserted in any order, between, above, or below any number of particular sheets 130. Sheets can be added, removed, and/or reinserted, all by opening binding unit 100, and subsequently rebinding/closing binding unit 100. FIG. 2 shows the assembled notepad 90 with dividers 140 that have been inserted in various places within pages 130 over base portion 150, and are all being held together by binding unit 100.

Figure 3:
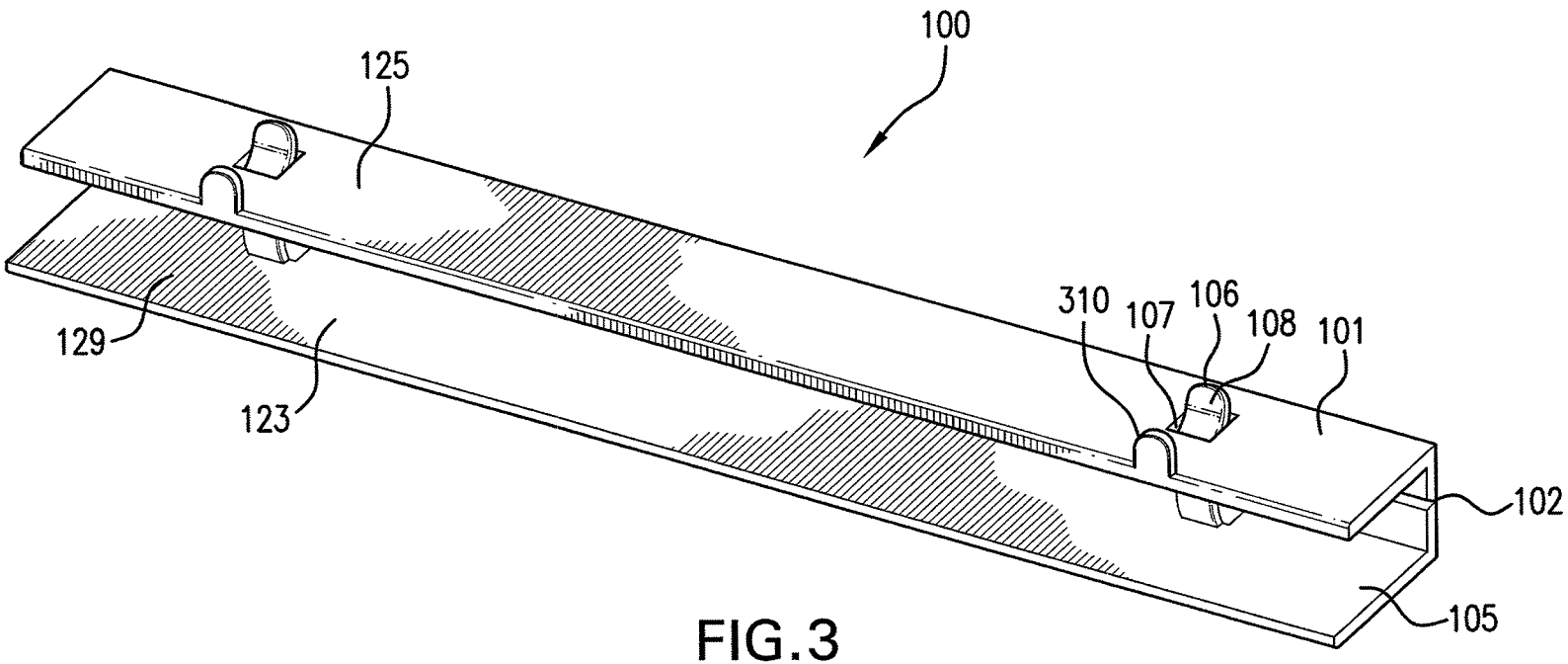
FIG. 3 is a perspective view of the binding unit thereof in a closed position.
Figure 4:
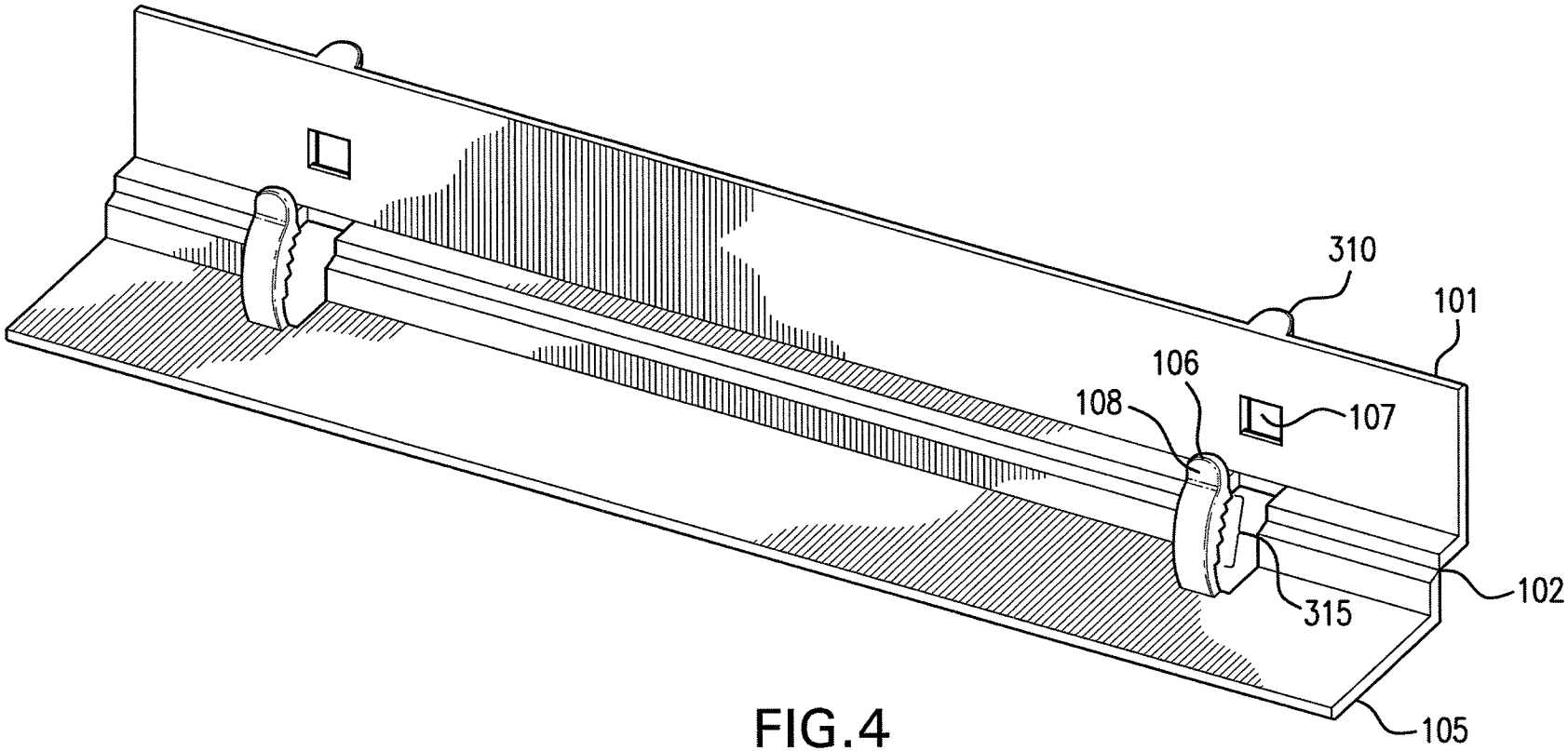
FIGS. 4 and 5 are front perspective views of the binding unit thereof in an open position.

The binding unit 100 is shown in FIG. 3 in a closed position (e.g., in a bound position), but without papers 130, dividers 140 or base portion 150 inserted therein. Binding protrusion 106 can pass through binding feature 107 and, in certain embodiments, interface with feature 107 in a securing/binding connection. This connection is further illustrated in FIGS. 4-10, and as illustrated in FIG. 3, binding protrusion 106 can connect and lock with feature 107. Moreover, protrusion 106 can have a degree of flexibility to move away from a locking edge 320 of feature 107, toward the center of feature 107. Pinching element 310 can assist a user in opening binding unit 100 by providing a surface to cooperatively pinch with manipulable portion 108 of protrusion 106, moving protrusion 106 toward pinching element 310, which can move protrusion 106 toward the center of 107, unlocking it from a locking wall of 107, and allowing first binding portion 101 to hinge open and disengage. In this way, protrusion 106 can be flexible/resilient to enable manual disengagement and further facilitate the engagement. Protrusion 106 can be tall enough to span the gap between first and second binding portions 101,105 in the closed position (at least when the upper and lower members 126, 128 are parallel) to close off openings therebetween through which papers could slide out of the binding.

Figure 7:
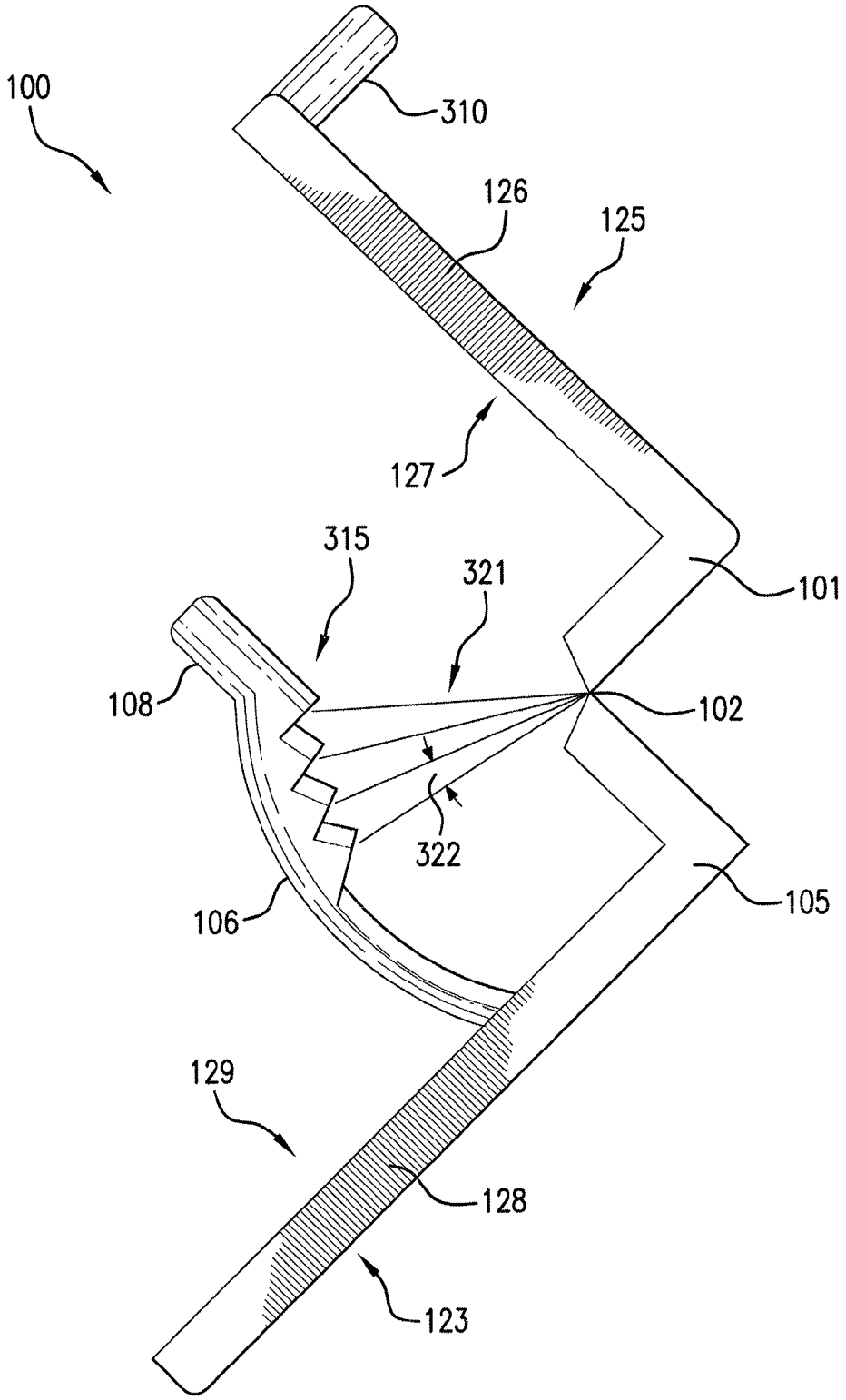
FIG. 7 is a side view of the binding unit thereof in an open position.
Figure 8:
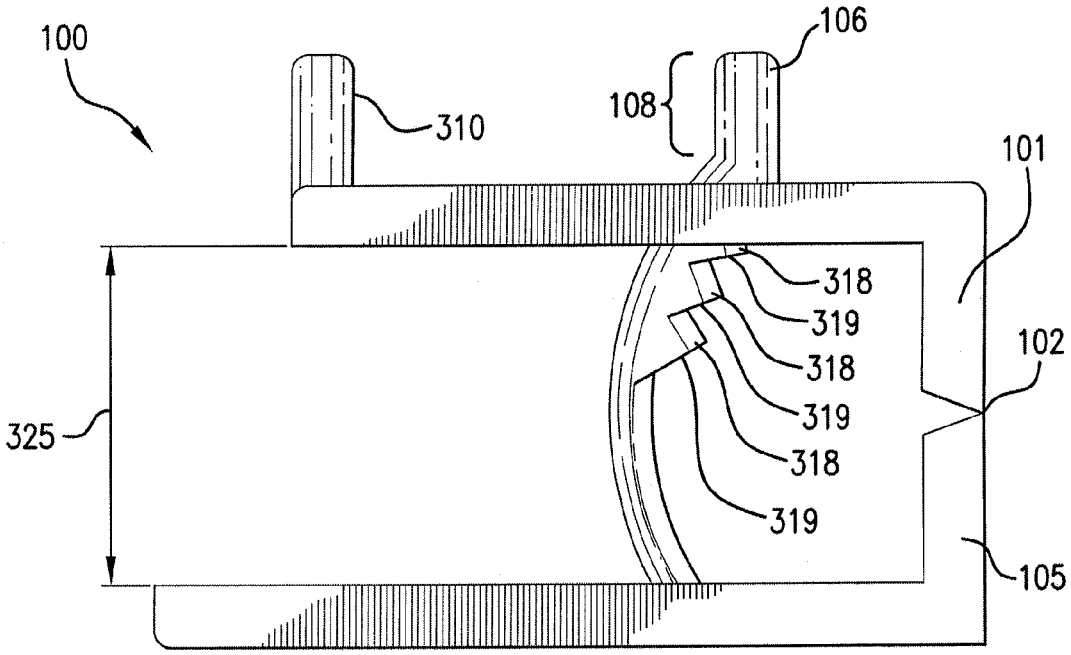
FIGS. 8-10 are side views of the binding unit thereof in different closed positions.
Figure 9:
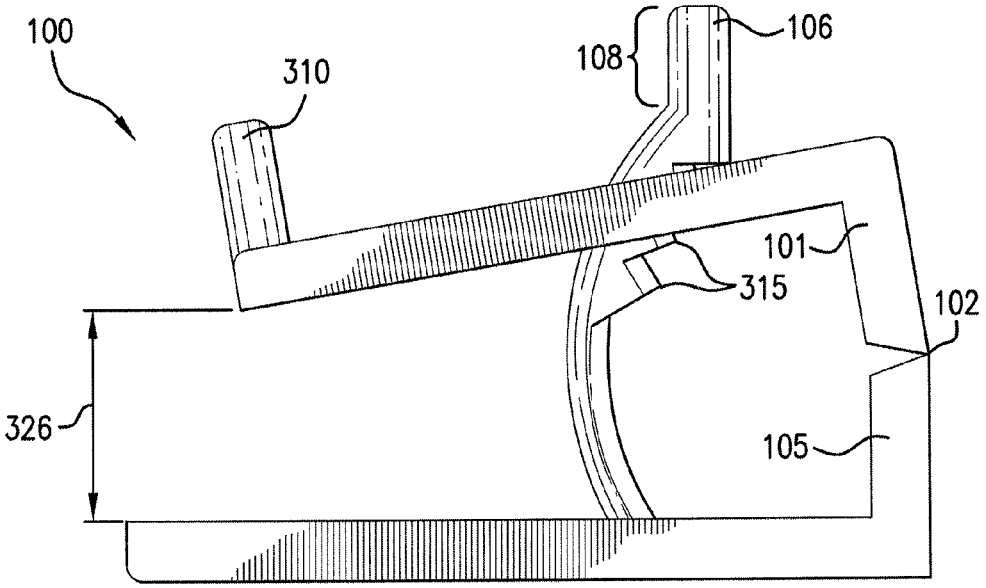

Protrusion 106 can include a number of teeth 315 and be arcuate, or any number of other suitable shapes. Each tooth can have a sloped, ratcheting surface 318 leading to a locking shelf 319, as seen in FIG. 8. The ratcheting surfaces 318 are angled with respect to the axis of hinge 102 and the second portion 105 to ratchet the first portion 101 into a closed position (shown in FIGS. 7 and 8), and from there into successively more closed positions (shown in FIGS. 9 and 10). The locking shelves 319, lock in each position against further opening or opening to a more open closed position, such as from a closed position, for example shown in FIG. 10, to a more opened closed position, for example as shown in FIGS. 8 and 9. Curvature of the binding protrusion 106 can correspond to the pivoting motion of the binding portions, as shown with radial lines 321 in FIG. 7.

The top of protrusion 106 can enter feature 107, which can include an engagement ledge 320, which can be slopped to facilitate nesting with teeth 315. As first binding portion 101 is hinged closed, the engagement ledge 320 of feature 107 facing teeth 315 can lock between two teeth, providing a removable binding. Protrusion 106 may be required to be pulled away from the locking wall, or preferably, teeth 315 can be configured such that closing the first binding portion 101 pushes the protrusion 106 such that protrusion 106 applies a resisting tension against the engagement ledge 320 of feature 107. The engagement ledge 320 of feature 107 can sit between or beyond any of the teeth 315, which can provide an adjustable dimension to the binding unit 100 (e.g., can securely bind different thicknesses of materials).

Angle 322 (shown in FIG. 7) between the peak of two adjacent teeth, radially measured from the hinge 102 can include a suitable number of sizes, such as 1 degree, 10 degrees, or any suitable magnitude of angle 322 therebetween. Teeth sizes and slopes can be configured to support any number of suitable locked positions, for any number of suitable angle degrees 322. Locking shelf 319 defines a recess with a depth extending radially away from the hinge 102 to receive and retain the locking ledge 320 of the binding portion 101. The locking shelf 319 can be any number of suitable depths from about 1 millimeter to about 10 millimeters or any suitable sizes therebetween, and should be sufficient to provide the locking engagement with ledge 320. The sloped angles of each tooth 315, including ratcheting surfaces 318 and locking shelves 319, can be configured at an angle that generally corresponds with the hinged movement, e.g., the radial arch of binding portion 101 as hinge 102 is pivoted.

Figure 6:
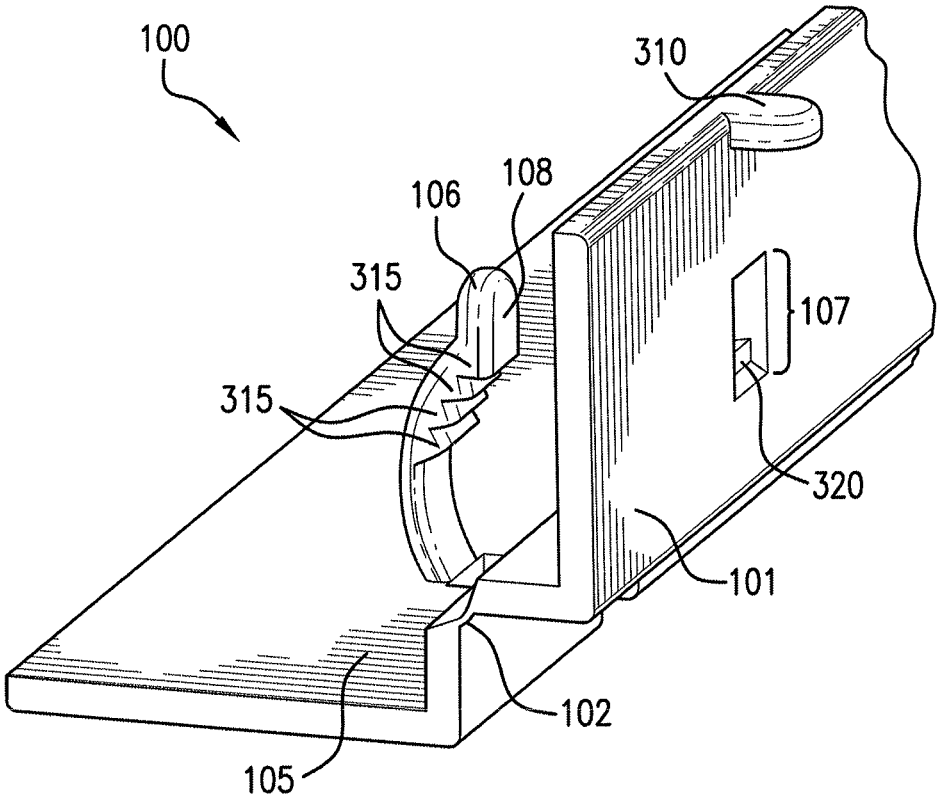
FIG. 6 is a rear perspective view of the binding unit in thereof in an open position.
Figure 10:
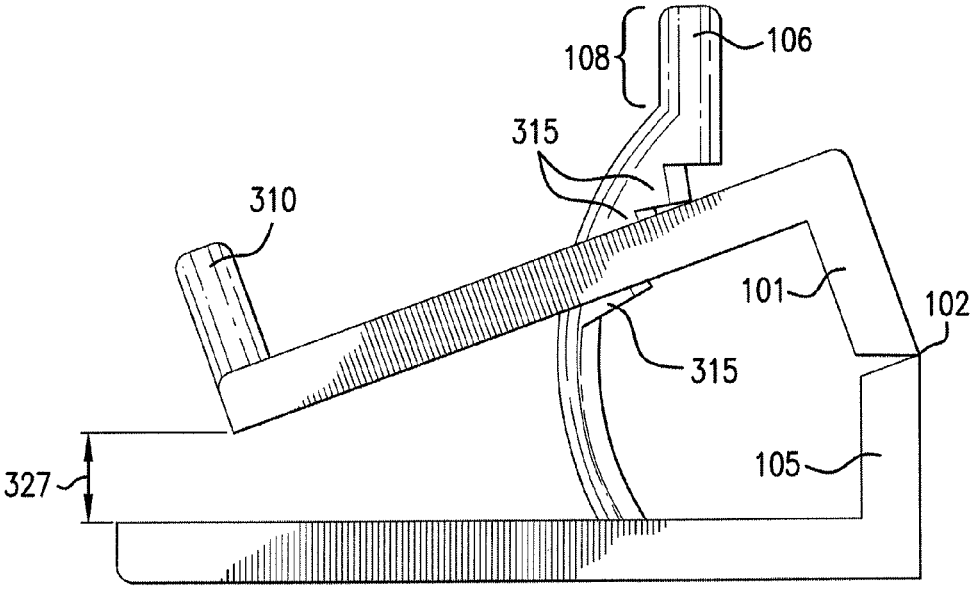

FIG. 6 illustrates another view of binding unit 100. In this view, the locking ledge 320 of feature 107 is visible from a top angle, and can include a sloped or recessed wall configured in alignment with the teeth 315 of binding protrusion 106. FIG. 7 illustrates a side perspective with binding unit 100 in the opened position, and protrusion 106 with teeth 315 fully disengaged with aligned feature 107 (not visible). FIG. 8 illustrates the side perspective with binding unit 100 in the closed position forming a "U" shape as hinge 102 connects portions 101 and 105 in a straight line. Here, with a stack of papers such as 130 (not shown) having a total thickness of approximately distance 325, the binding unit 100 can substantially resemble a notepad arrangement, and provide a minimalist and substantially flush binding for such papers 130 and dividers 140, etc. As shown, portion 105 may be longer than portion 101, or alternatively may be equal or shorter in length. Hinge 120 can be located halfway up the hinged wall, at either corner (e.g., causing one portion to be straight and the other to have an "L" shape), or anywhere therebetween. In FIG. 8, of the locking ledge 320 of feature 107 is shown in the first tooth 315 position. In FIG. 9, of the locking ledge 320 of feature 107 is shown in the second tooth 315 position, thereby causing a shorter distance 326 between portion ends. FIG. 10 illustrates locking wall 320 of feature 107 between the last and second to last tooth 315, causing an even shorter distance 327 between portion ends. While not shown, other exemplary embodiments can be configured to allow of the locking ledge 320 of feature 107 to rotate past the last tooth 315, and thereby fix portion 101 by the last tooth 315 in an upward direction and portion 105 (and/or any bound materials) in a downward direction.

Figure 11:
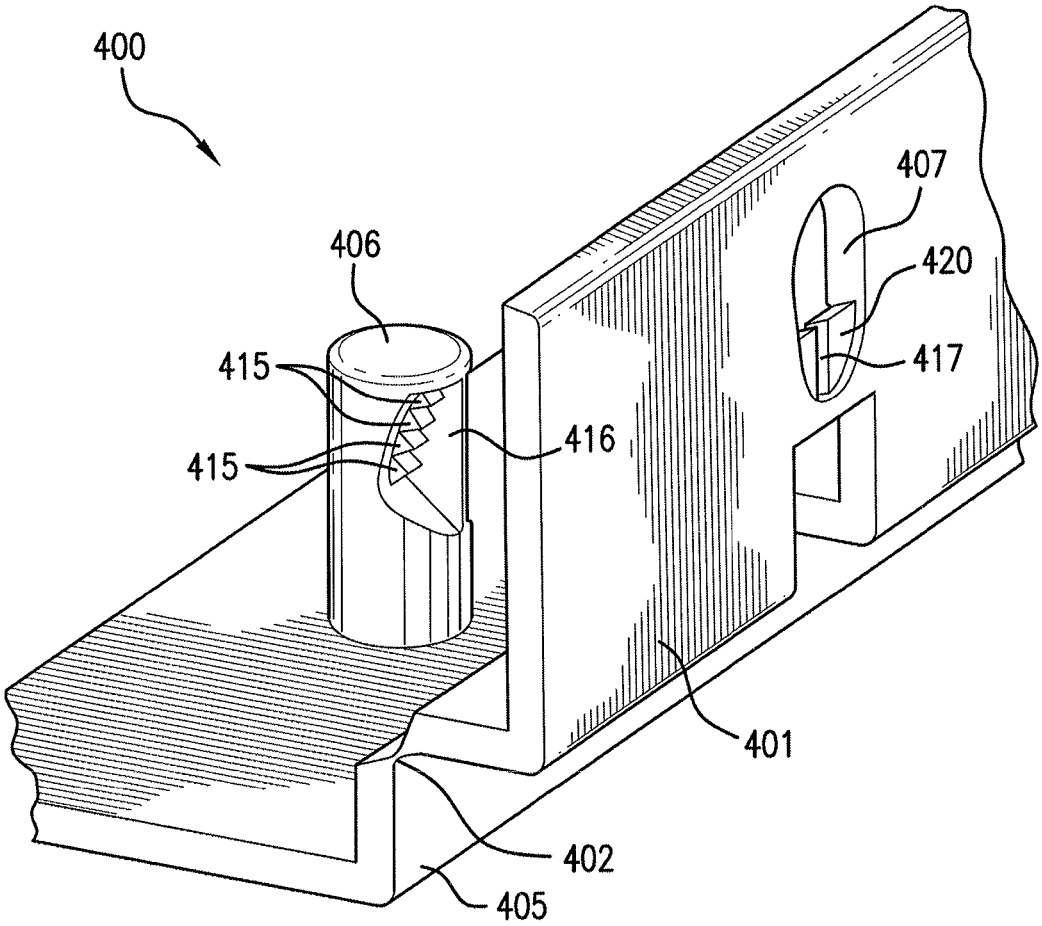
FIGS. 11 and 12 are rear and front perspective views of a binding unit of another exemplary embodiment in an open position.
Figure 12:
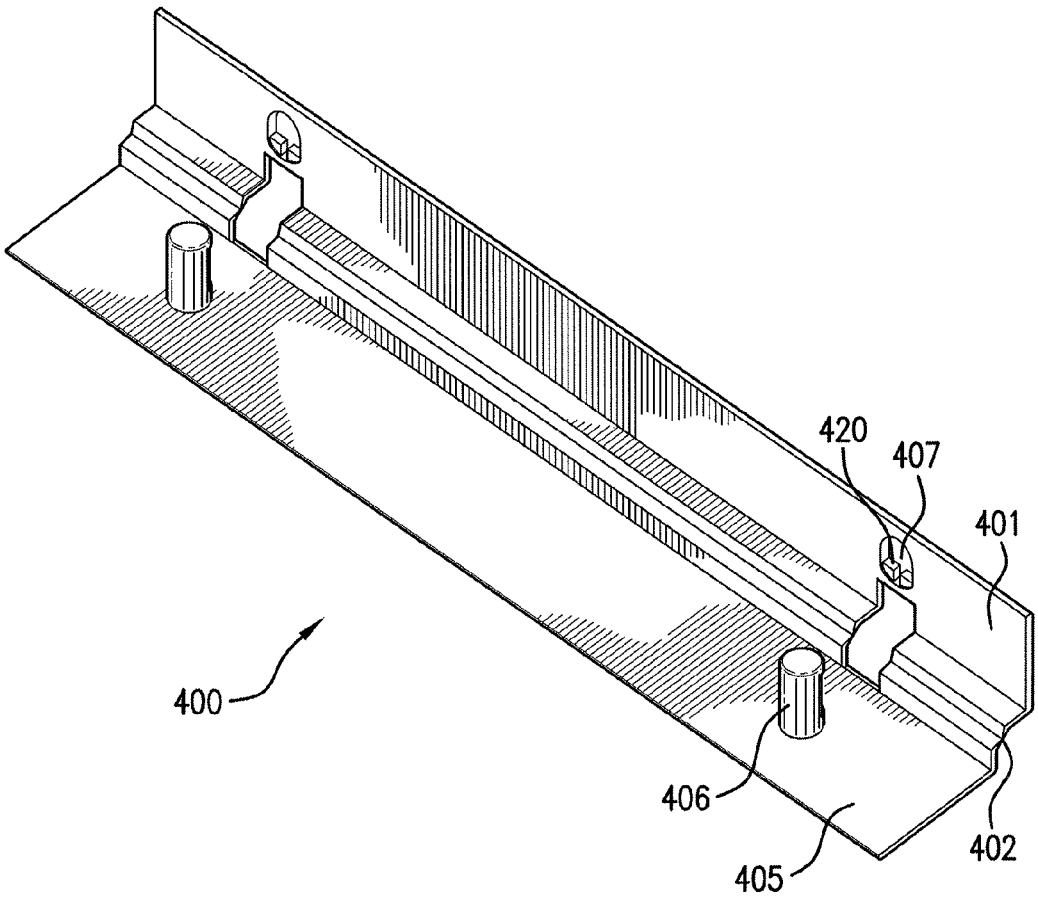

FIG. 11 illustrates another exemplary binding unit 400, including first portion 401, second portion 405, and connecting hinge 402. First portion 401 can include a binding feature 407 with a locking tongue 420, which can be a segment of the locking wall of the locking ledge 320 or other locking feature of 107. The tongue 420 can be thinner than first and second binding portions 101,105 to provide greater flexibility. Tongue 420 can include two locking tongue halves separated by a gap, as illustrated in FIG. 11. Binding feature 407 can be dimensioned and aligned to receive binding protrusion 406, which can include one, two, or more sets of teeth 415. For example, binding unit 400 can include two binding protrusions 406, each with two sets of teeth 415 separated by a wall 416. The wall can be aligned to fit into the gap 417 between locking walls 420. In the prior exemplary binding unit, the binding protrusion 406 flexed to facilitate a locking nesting with feature 107. Here, protrusion 406 can also flex, or preferably remain rigid, while locking walls 420 provide sufficient flex to pass over teeth 415 and nest therein. Locking walls 420 can also have a sloped end to help facilitate nesting, while teeth 415 can also have slopes to facilitate progression through the teeth. Teeth 415 can be arranged along a curve within the structure of protrusion 406, similar to the arched arrangement of teeth 315. Similarly, teeth 415 can include locking shelves angled to correspond to different radial positions of binding portion 401 at different angles of hinge 402. Tongue halves 420 can also be sloped, to facilitate flexing during ratcheting down into the closed and locked positions. FIG. 12 shows another angle of binding unit 400.

Figure 13:
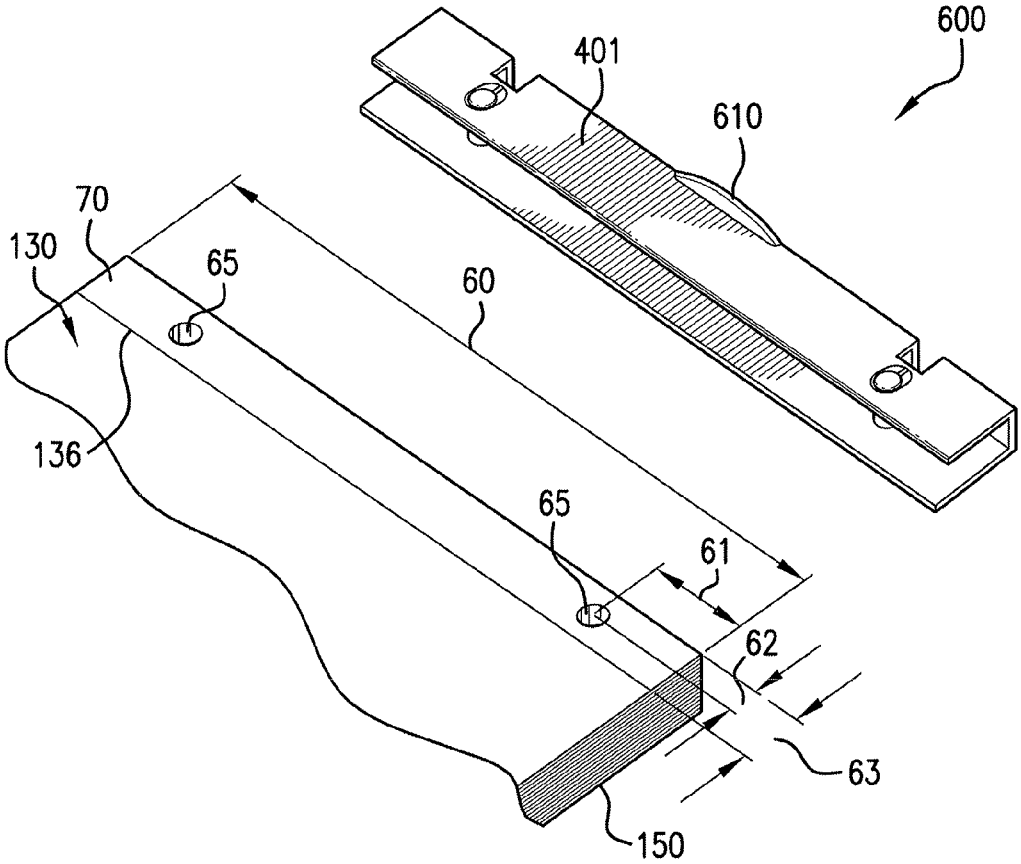
FIG. 13 is a front perspective view of the binding unit of the embodiment of FIGS. 11 and 12 with a stack of paper and a base portion to be attached thereto.

FIG. 13 illustrates another binding unit 600 similar to binding units 400 and 500, with a different exemplary prying portion 610, located on the corner of first portion 401. FIG. 13 also illustrates an exemplary pad of paper 130, with holes 65 for insertion over binding protrusions. The holes can include any number of suitable sized diameters, such as about 0.1 inches to about 0.5 inches or any suitable size therebetween, preferably about 0.35 inches. The holes, e.g., the center of the hole, can be located distance 61 from the paper stack 130 edge. This can be any suitable distance such as about 0.5 inches to about 1.5 inches or any suitable size therebetween, preferably about'1.25 inches. Holes 65 can be located distance 62 from the paper stack 130 top edge. This can be any distance such as about 0.1 inches to about 0.5 inches or any size therebetween, preferably 0.375 inches. Holes 65 can be included on a perforation strip 70 defined by a perforation line 136. Perforation strip 70 can be any portion of the notepad including distance 63. This can be any distance such as about 0.5 inches to about 1.5 inches or any size therebetween, preferably 0.75 inches. The pad can include a width 60 substantially similar to a width of the binding unit 600, which also can be any distance, including at least about 4 inches to about 15 inches or any size or range therebetween. Preferably, paper width 60 can have a standard size of about 8.5 inches, or any other suitable size associated with a standard paper size format.

Figure 14:
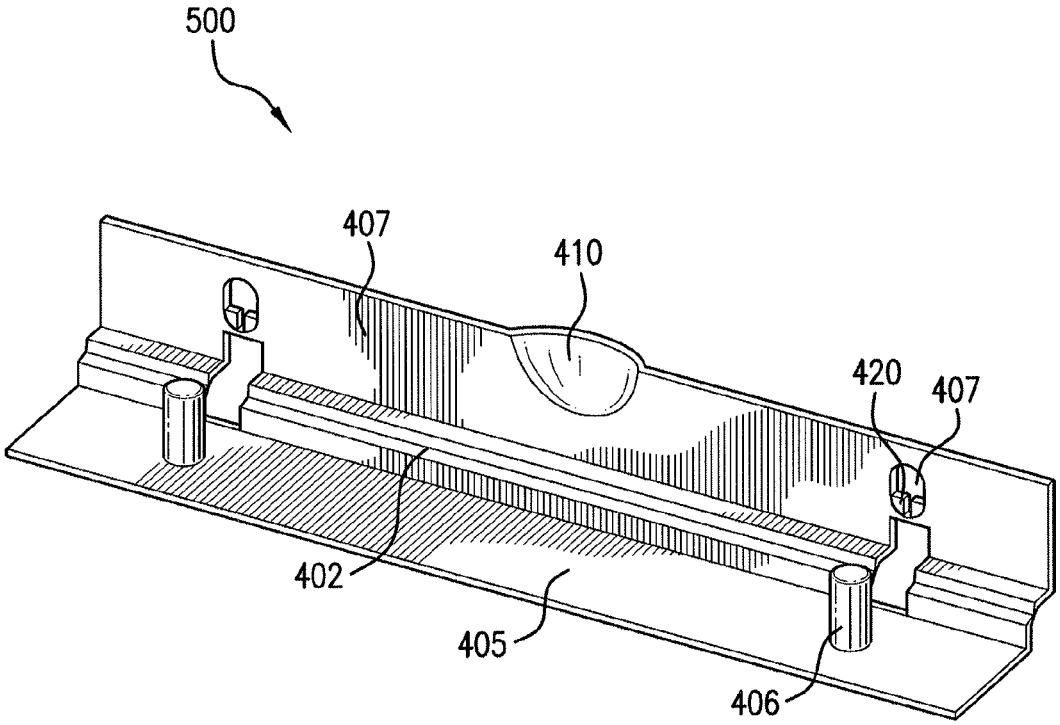
FIGS. 14 and 15 are front and rear perspective views of a binding unit of another embodiment in open and closed positions, respectively.
Figure 15:
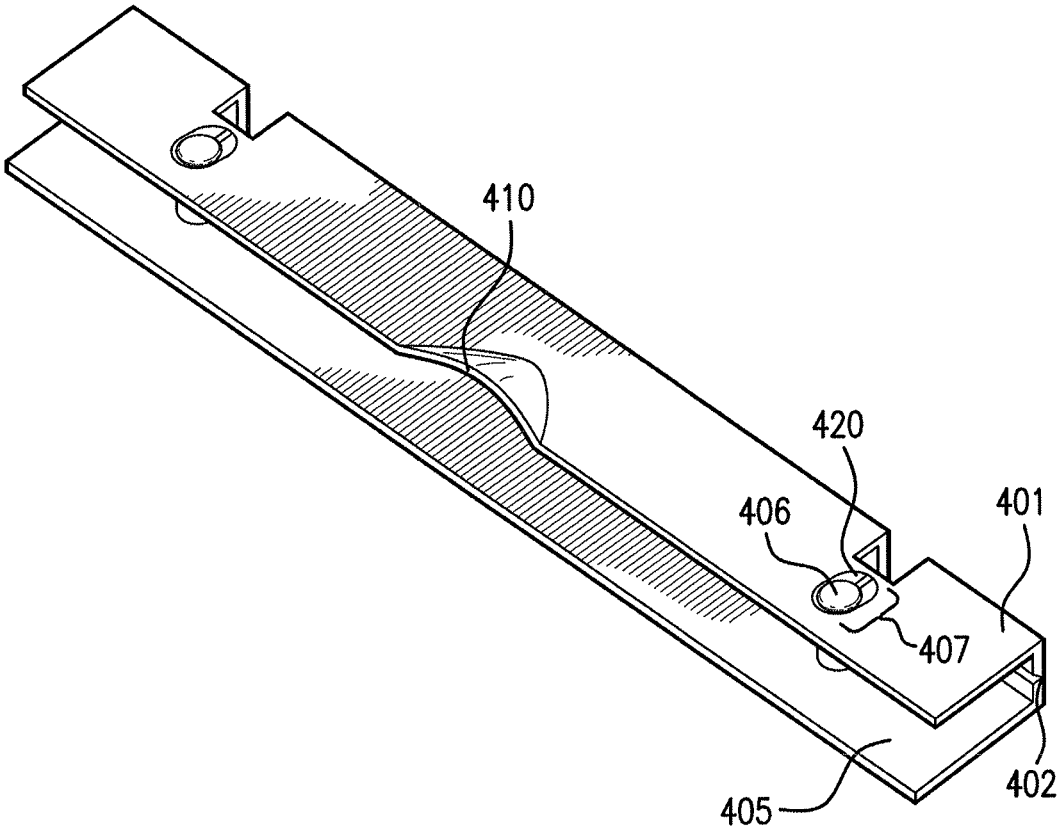

FIG. 14 illustrates another exemplary binding unit 500, similar to binding unit 400, and with a prying feature 410, which can be used by a user to assist with opening (e.g., de-binding) binding unit 500. FIG. 15 illustrates exemplary binding unit 500, with portions 401 and 405 in the closed position, along with protrusion 406 within feature 407, and locking walls 420 nested within teeth 415 (not shown).

While the exemplary embodiments illustrated in the foregoing drawings includes at least two different binding mechanisms, other mechanisms are also possible, including single nesting area mechanisms (e.g., without multiple teeth). Binding sets can come with a backing such as a base portion, a cover, dividers, tabbed dividers, loose sheets of paper, sheets bound into one or more groups, or any number of other configurations or set groupings. In certain exemplary embodiments, the binding unit can create a substantially flat (e.g., "U" shaped profile) and flush binding, similar in appearance to a notepad's profile, but with configurable features illustrated in the above exemplary embodiments. Other exemplary embodiments can be substantially flat and flush, except for pinching, prying, and/or grabbing features, and/or binding protrusions extending past the top (e.g., first) portion.

Exemplary embodiments can be formed from any number of sizes, materials, shapes, dimensions, and/or thicknesses. For example, the thickness of portion 101 or portion 105 can be about half a millimeter, about 10 millimeters, or any size therebetween. The width of binding units (e.g., 100) can be any size, including standard paper sizes, for example 8.5 inches or the width of A4 standard paper. The length of the major surface of a binding portion (e.g., 101), can be about a quarter inch to several inches or any size therebetween, and preferably can be about ⅞ of an inch or about an inch. The height of exemplary binding units can be about ⅛ of an inch to several inches (e.g., three) or any size therebetween, and preferably about a quarter of an inch. The bound material can have a maximum thickness, e.g., a maximum thickness where aligned binding elements can still nest or still nest in their maximum position for multi-position elements. This maximum thickness can be any dimension, including 1/32 of an inch to several inches (e.g., three) or any size therebetween). The height of exemplary binding units less the maximum thickness of bound material for those exemplary binding units can define an added thickness, e.g., a thickness greater than the maximum thickness added to the bound embodiments by the binding unit itself. This added thickness can be any size, or any proportional size to the maximum thickness. For example, the added thickness can be about 1 percent of the maximum thickness, thereby creating a substantially flush binding. The added thickness can preferably be about or less than 10% or 5% of the maximum thickness, thereby again creating a maximum added thickness in proportion to the overall possible thickness (e.g., 110% of the maximum thickness).

Any and/or all of the references specifically identified in the detailed description section of the present application are expressly incorporated herein in their entirety by reference thereto. The term "about" and "approximately," as used herein, should generally be understood to refer to both the corresponding number and a range of numbers. Moreover, all numerical ranges herein should be understood to include each whole integer within the range. Also, exemplary paper, dividers, and other materials can be of any size, shape, and/or material, including standard sizes, e.g., letter, legal, A4, etc.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. An adjustable binding system, comprising:

a first portion; and a second portion hingedly coupled to the first portion, wherein the second portion includes protrusions to align with punched holes of punched paper and to be inserted through the punched holes to retain the punched paper, wherein the protrusions are to extend through and past the first portion, and wherein the first portion includes retaining features in alignment with the protrusions to releasably secure the protrusions, wherein at least one of the protrusions includes two sets of teeth on two sides of a dividing wall and at least one of the retaining features include two lock elements on either side of a gap aligned with the two sets of teeth and dividing wall to be releasably held by the teeth.

2. The binding system of claim 1, wherein the first portion includes a grabbing feature to extend away from the punched paper secured by the binding system.

3. The binding system of claim 2, wherein the protrusions extend through and past the first portion at a distance less than the grabbing feature extends away from the punched paper.

4. The binding system of claim 1, further comprising a backing having a width dimension and length dimension approximately equal to a width and a length of the punched paper, wherein a height of the backing is less than a height of the punched paper and greater than a height of a sheet of paper within the punched paper, wherein the backing is substantially more ridged than a sheet of the punched paper.

5. The binding system of claim 4, further comprising at least one divider having a width and a length approximately equal to the width and the length of the punched paper, wherein the at least one divider is more ridged than a sheet of the punched paper and less ridged than the backing, and wherein a tab feature on an edge of the divider protrudes beyond a remaining portion of the edge.

6. The binding system of claim 5, wherein the at least one divider is removable from the releasably secured first portion and second portion.

7. The binding system of claim 6, wherein the at least one divider includes at least three dividers.

8. The binding system of claim 1, wherein a width of the second portion is at least three times larger than a length of the second portion.

9. The binding system of claim 8, wherein the punched paper has a length greater than the width of the second portion.

10. The binding system of claim 9, further comprising a backing having a width approximately equal to the width of the second portion and a length approximately equal to the length of the punched paper.

11. The binding system of claim 1, wherein the first portion is to cover a portion of a top-most sheet of the paper.

12. The binding system of claim 11, wherein the first portion is to cover less than 20% of the top-most sheet.

13. The binding system of claim 1, wherein the plurality of sheets of paper each include a perforation line running a width of the sheet and dividing a part of the sheet that includes the punched holes and a remaining portion of the sheet, wherein the perforation line is near the punched holes and the remaining portion of the sheet is substantially larger than the part of the sheet that includes the punched holes.

14. The binding system of claim 1, wherein the first portion and the second portion are to bind a maximum thickness of bound material when the lock elements are held by the teeth, wherein a height of the binding system is perpendicular to both a width and a length of the binding system, wherein the height is measured from a top of the first portion to a bottom of the second portion, and wherein the height is larger than but approximately equal to the maximum thickness.

15. The binding system of claim 14, wherein the height is less than 10% greater than the maximum thickness of bound material.

16. The binding system of claim 1, wherein the lock elements are affixed to or integrally formed from the first portion, wherein teeth are affixed to or integrally formed from the second portion.

17. The binding system of claim 1, wherein the lock elements are directly connected to the first portion and not directly connected to the second portion, and wherein the teeth are directly connected to the second portion and not directly connected to the first portion.

* * * * *